United States Patent [19]

Graf

[11] Patent Number: 5,046,225

[45] Date of Patent: Sep. 10, 1991

[54] DRAWING BATH

[75] Inventor: Felix Graf, Winterthur, Switzerland

[73] Assignee: Rieter Machine Works, Ltd., Winterthur, Switzerland

[21] Appl. No.: 484,186

[22] Filed: Feb. 23, 1990

[30] Foreign Application Priority Data

Feb. 24, 1989 [CH] Switzerland ..... 00684/89

[51] Int. Cl.[5] ..... D01D 5/14

[52] U.S. Cl. ..... 28/246; 28/240; 264/290.5

[58] Field of Search ..... 28/240; 264/181, 290.5

[56] References Cited

U.S. PATENT DOCUMENTS

| | | | |
|---|---|---|---|
| 2,289,232 | 7/1942 | Babcock | 28/245 X |
| 3,002,804 | 10/1961 | Kilian | 28/240 X |
| 3,124,631 | 3/1964 | Davis et al. | 28/240 X |
| 3,379,811 | 4/1968 | Hartmann et al. | 264/290.5 X |
| 3,633,256 | 1/1972 | Mallonee et al. | 28/240 |
| 4,035,879 | 7/1977 | Schippers | 264/290.5 X |
| 4,059,668 | 11/1977 | Bittle et al. | 264/290.5 X |
| 4,836,507 | 6/1989 | Yang | 264/181 X |
| 4,863,662 | 9/1989 | Hasegawa et al. | 264/557 X |

*Primary Examiner*—Werner H. Schroeder
*Assistant Examiner*—John J. Calvert
*Attorney, Agent, or Firm*—Kenyon & Kenyon

[57] ABSTRACT

A method for drawing a synthetic thread having a fibril bundle delivers the thread as a ribbon of substantially parallel fibrils through a drawing bath to effect a hydrodynamic braking of the filaments and simultaneous drawing of the filaments. A ceramic pin is used to form the fibrils into parallel relation and substantially in one plane. A second ceramic pin may also be used as a mechanical brake to add to the hydrodynamic braking action by the liquid in the drawing bath. The base and cover of the drawing device are provided with channels to define the flow path for the bath liquid as well as inlet and outlet channels for the liquid. Suction nozzles or air nozzles may be provided at the inlet and outlet ends of the flow paths to remove excess liquid from the fibrils.

24 Claims, 5 Drawing Sheets

FIG. 6A
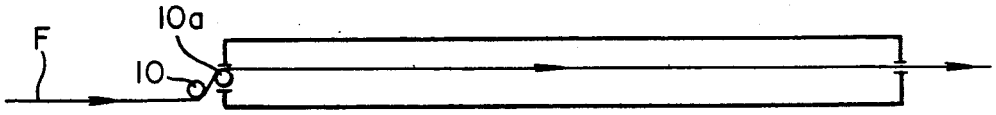
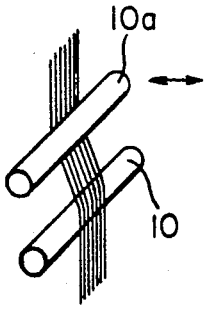
FIG. 6B
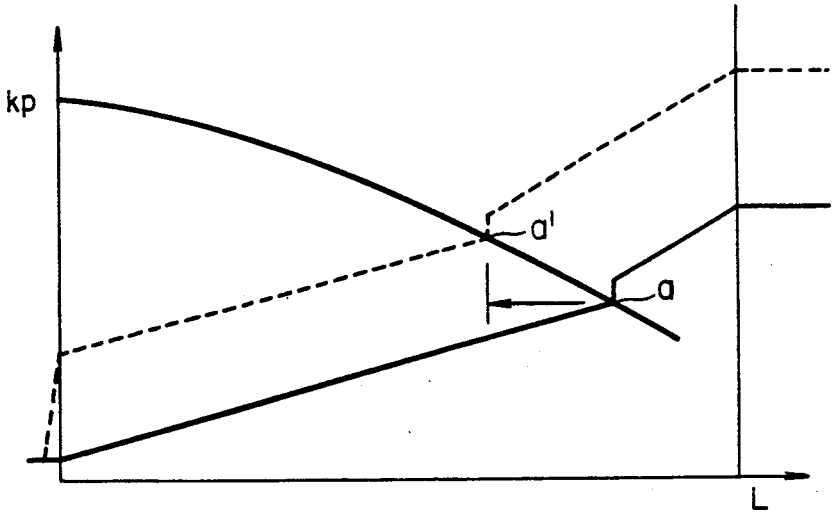
FIG. 6C
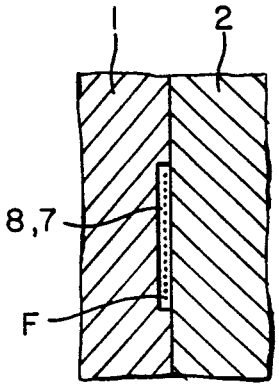
FIG. 3A
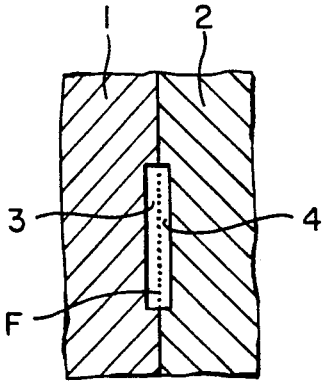
FIG. 3B

DRAWING BATH

This invention relates to a drawing bath. More particularly, this invention relates to a process and device for drawing synthetic filaments.

In the production of synthetic filaments, or more precisely, linear polymeric filaments (smooth yarns), the filaments must be drawn shortly after extrusion in order to obtain an orientation of the molecules along the filament axis. Only following this drawing process does the synthetic filament first reach its elastic drawing limit with regard to extensibility. The drawing elongation for orienting the polymers is considerable generally amounting to a multiple of its original length. The prior art teaches that drawing elongation must take place in a small, defined drawing zone, in order to obtain uniform filament characteristics over the entire length (U.S. Pat. No. 2,289,232). This widely held although doubt was expressed about this idea some 20 years later (U.S. Pat. No. 3,002,804) and was opposed by a non-mechanical drawing process, but which was only successful at high thread speeds which were not attainable at that time. However, in spite of the increasing thread speeds, at present up to 6000 meters/second (m/sec), the drawing processes are still effected mechanically at a cost and effort which is not inconsiderable.

The moving away from the constraint of "drawing zones as small as possible" permitted the introduction of the idea of a hydraulic or liquid brake between the spinning nozzle and winding machine in which naturally the filament cannot be drawn off as "sharply" but, instead very uniformly, compared with a mechanical braking arrangement. In any case, limits were set with this early idea (1961), which, up until today, have not permitted an industrial use. Thus, the process described in U.S. Pat. No. 3,002,804 has remained a laboratory process in spite of all the advantages and has not been used in the actual manufacture of synthetic yarns. This is still the case, as indicated by German 35 34 079, according to which industrial use of such a process was prevented by significant disadvantages. It has also been found that this short drawing occurs even when the braking process is carried out in a liquid medium.

As indicated in FIG. 5 of U.S. Pat. No. 3,002,804, the high thread speeds require smaller passage lengths in the chamber, which is desirable in itself, however it becomes apparent that this is only detectable at speeds from 5000 yards per minute and only increases slightly at higher speeds. Thus, this process could offer advantages from the point of view of its dynamics. However, in view of the requirements of modern high speed yarn production prospects for an adequate liquid bath braking process have not been good. Too many questions are still open today, for example, the flow conditions in the chamber at high filament speeds, while the method suffers from too many technical inadequacies, for example the passing of the fibrils through a small ring (which must be neither too small nor too large), so that it cannot be put into practical effect on the basis of existing knowledge. The fact that the higher the speed of passage, the smaller the braking zones (passage distances), is counteracted by the experience that the higher thread speeds make the technical manipulation and the parallel-guided multithread drawing process disproportionately more difficult.

The use of a brake bath is considered so disadvantageous in German 35 34 079 that drawing by means of a drawing pin is retained and an attempt is made to solve the problem with liquid friction against such a type of pin. The described process is an attempt to solve the problem of adequate water application to the thread. This wetting problem is solved in that the stretched thread bundle is passed with parallel filaments through a liquid film which is applied in dosed form to cylindrical brake surfaces. The cylindrical surfaces, preferably have a thread groove and the capillary force between the filament bundle further assists the wetting process. The liquid must not be hydroextracted or torn away from the cylindrical surface to collect in the thread areas remote from the brake surface. However, there is a considerable risk of the liquid film still tearing and of the thread running dry and of this remaining unnoticed. In this case, hydrodynamic friction then passes into undesired mechanical friction. A temperature control in a thin liquid film is also very difficult. Thus, it must be expected that drawing takes place below the second order transition point (at a brittle temperature). Thus, brittle fractures can occur. The process overall appears to be technically problematical.

Accordingly, it is an object of the invention to use a liquid bath process for the drawing of synthetic filaments despite all of the existing prejudices.

It is another object of the invention to provide a practical realization of a liquid bath method and device for drawing synthetic filaments.

Briefly, the invention provides a process for drawing synthetic filaments wherein a plurality of synthetic filaments are guided in a parallel manner and in a narrow ribbon shaped pattern into a drawing bath to effect a hydrodynamic braking of the filaments and simultaneous drawing of the filaments.

In addition, the filaments may be guided over a deflecting device in order to impose a mechanical braking force on the filament.

The invention also provides a device for drawing synthetic filaments which includes a base, a cover mounted on the base for movement between an open and a closed position with one of the base and cover having a channel to define a flow path for a drawing bath in the closed position, and means at one end of the flow path for guiding a plurality of synthetic filaments in a parallel manner and in a narrow ribbon shaped pattern into the channel for passage therethrough.

The device is also provided with a means for passing a bath liquid into the flow path for drawing of the filaments passing therethrough. This means includes an inlet in the base for supplying bath liquid to one end of the channel and an outlet in the base for exhausting bath liquid from an opposite end of the channel.

In order to remove excess liquid from the filaments passing out of the flow path, a chamber is located at the end of the flow path for removal of liquid from the filaments passing through this end of the flow path. In addition, a suction means is placed in communication with the chamber for drawing liquid therefrom under a suction force.

Alternatively, an air outlet nozzle may be provided at the end of the flow path for blowing air across the filaments thereat in order to remove liquid therefrom. In this case, the suction opening may also be provided opposite to the nozzle in order to receive air and any entrained liquid therein.

In order to further control the braking action on the synthetic filaments, a mechanical brake means may also be disposed in the flow path for the filaments. For example, the brake means may be in the form of a brake pin disposed across an inlet end of the flow path. Alternatively, the brake means may include a plurality of baffle plates disposed along the flow path for guiding the filaments through the flow path in a plane spaced from a mating plane between the base and the cover.

Alternatively, at least one of the base and cover may be provided with an undulating surface defining a wall of the channel in order to impart a transverse flow component onto the filaments.

The process provides a braking action which is to take place by hydrodynamic friction but without any necessity to carry out a film-like liquid application to the brake surfaces of a mechanical drawing unit.

These and other objects and advantages of the invention will become more apparent from the following detailed description taken in conjunction with the accompanying drawings wherein:

FIGS. 1*a* to 1*d* graphically represent the approximate behavior of a filament passing through a drawing bath in accordance with the invention;

FIG. 2 illustrates a perspective view of a drawing bath device constructed in accordance with the invention;

FIG. 3*a* illustrates a cross sectional view of a modified channel arrangement of a drawing bath device constructed in accordance with the invention;

FIG. 3*b* illustrates a part cross-sectional view of the drawing bath device of FIG. 2;

Figure 1A:
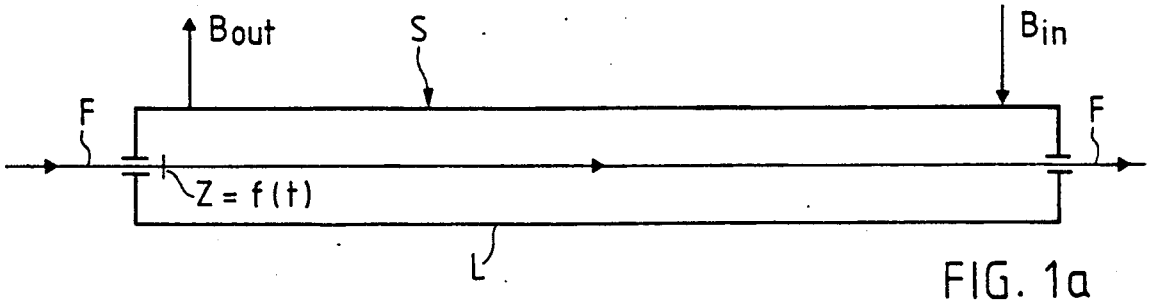
Figure 7:
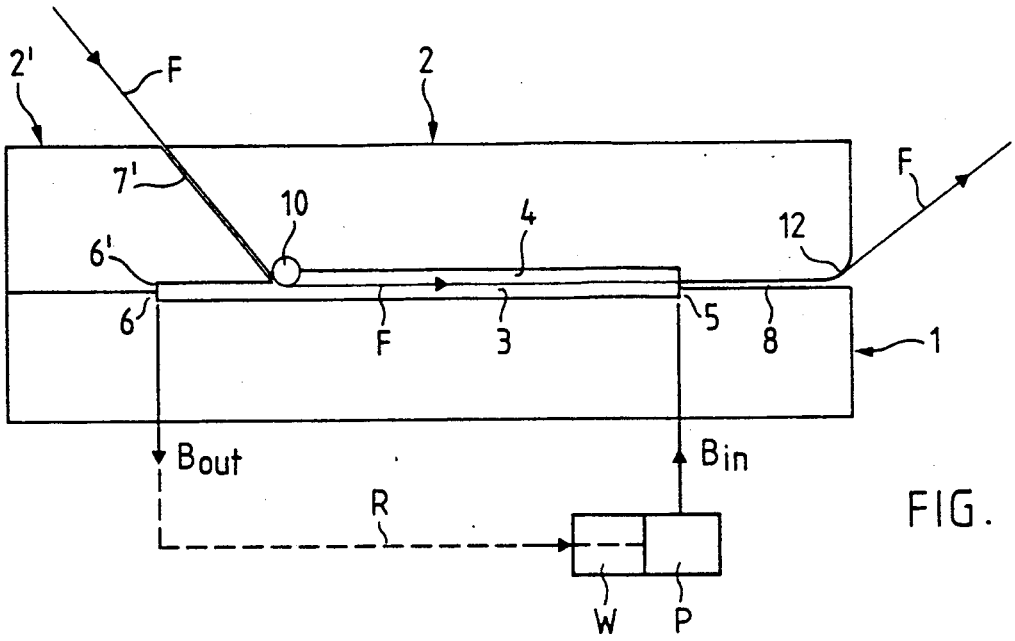
Figure 8:
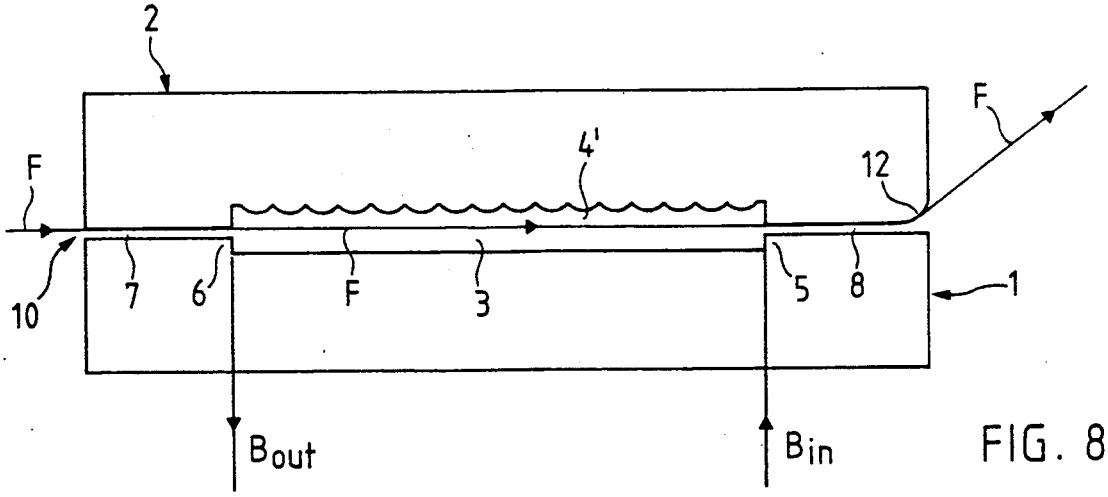
Figure 9:
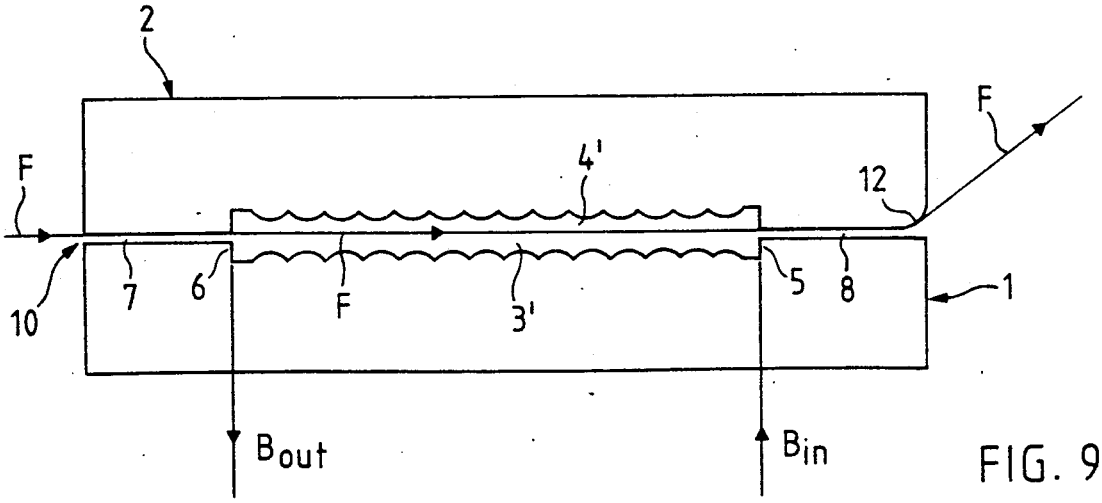

FIG. 6A schematically illustrates a side view of a drawing bath device constructed in accordance with the invention;

FIG. 6B illustrates a perspective view of a pair of pins for guiding the fibrils into the drawing bath device;

FIG. 6C graphically illustrates the operation of a drawing bath device employing an additional mechanical braking device in order to compensate hydrodynamic braking losses due to lower threads passage speeds;

FIG. 7 schematically illustrates a modified drawing bath device constructed in accordance with the invention;

FIG. 8 schematically illustrates a further modified drawing bath device employing an undulating wall in accordance with the invention; and FIG. 9 schematically illustrates a drawing bath device employing a pair of opposed undulating walls in the cover and base in accordance with the invention.

Referring to FIG. 1, the temperature and mechanical tension behavior of a moving fibril in a liquid bath as a function of the length of the drawing bath (i.e. the bath depth) as illustrated.

FIG. 1 a schematically shows a drawing bath device S of length L, through which a fibril F passes from left to right. Near to the inlet of the drawing bath, there is a small zone on the fibril indicated as Z =f(t), from which zone the temperature pattern is considered during the passage through the drawing bath. The drawing bath medium is continuously, in this case from $B_{in}$ to $B_{out}$, i.e. in counterflow. Naturally, the drawing bath can also be operated in a co-current manner.

Figure 1B:
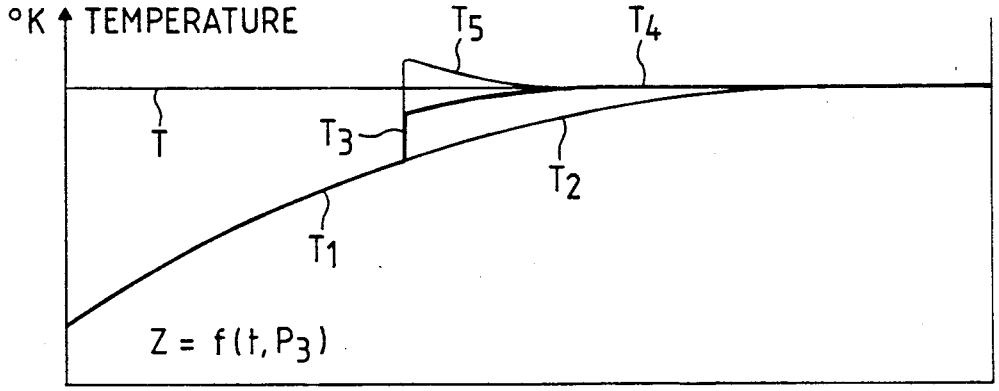

FIG. 1*b* shows the temperature pattern of the small defined fibril zone Z on its passage through the drawing bath, with $T_x$ designating different temperature sections relative to the length of the drawing bath. The temperature pattern is largely dependent on the passage speed and the drawing or thread tension.

Figure 1C:
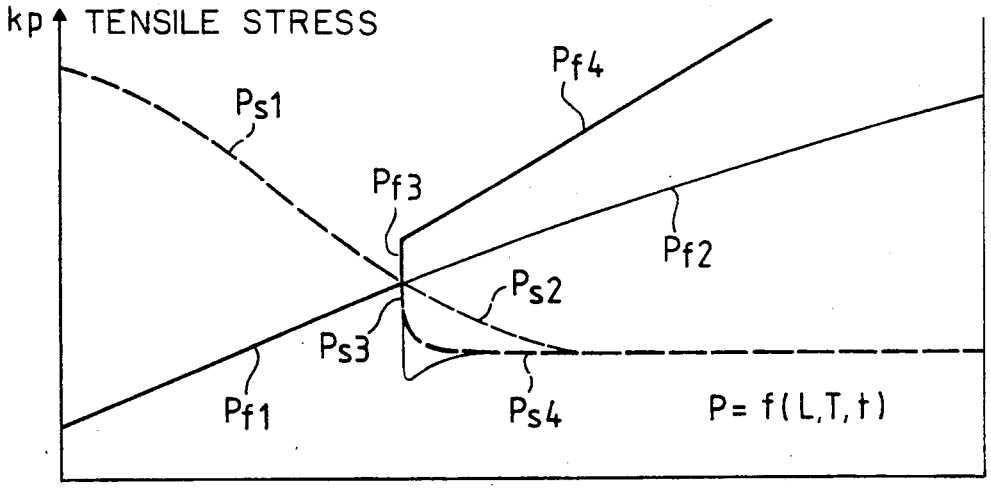

FIG. 1*c* shows the mechanical tension P (tensile stress in kp or Pascal) with two different force considerations namely the drawing tension $P_a$ and the tensile stress $P_f$ (thread tension). Different sections of thread tension are shown with $P_y$ or $P_x$.

Figure 1D:
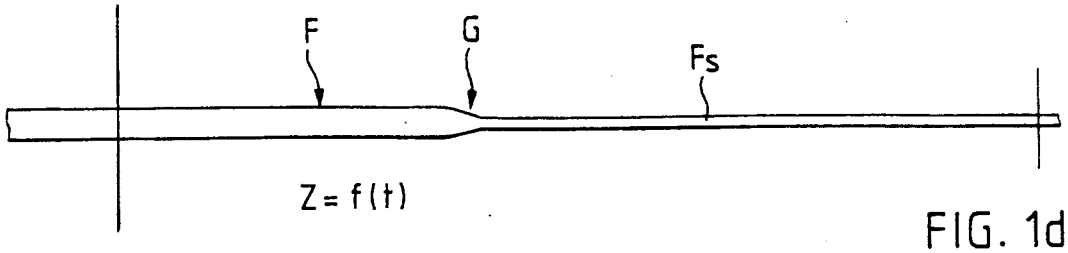

Finally, FIG. 1*d* shows the geometrical change in the defined fibril zone Z on its path through the drawing bath, namely before and after a relatively well definable range G, the second order transition point. It is at least necessary to reach this temperature to carry out the drawing process. Below this temperature, the filament is brittle (brittle fractures), while above this temperature, the strength decreases. Thus, the ideal chamber temperature is the second order transition point.

The drawing operation runs approximately according to FIG. 1 in the following way. Prior to entering the drawing bath, the filament, or fibril, has a low temperature (i.e. the quenching temperature which is of at least 50° C. lower than the melting point). After entry into the drawing bath, the filament heats relatively quickly up to the temperature of the drawing bath (roughly in the first half of the bath). With increasing heating, the necessary drawing tension for drawing the polymer decreases in roughly the same degree, as the temperature in the fibril rises due to heating in the drawing bath. This is particularly marked in th vicinity of the second order transition point.

The thread tension ($P_f$) would constantly rise in the drawing bath as indicated by the line $P_{f2}$ if a drawing operation did not take place. At the graphic intersection of the two inversely proportional functions of drawing tension ($P_s$) and thread tension ($P_f$), there is a spontaneous drawing ($P_{f3}$, $P_{s3}$). This leads to a sudden increase of the thread temperature (drawing energy, internal friction, release of internal tension) whereby the energy released ($T_3$; T >>related to 6t) being rapidly removed through the liquid surrounding the filament if the thread temperature is above the bath temperature. This avoids excessive heating in the drawing zone (G), this possible overheating is designated with $T_5$.

Due to the small thermal sink of the thread and the large thermal sink of the bath, the drawing process can be performed in such a way that there is approximately isothermal drawing. Optionally, the mass flow of the bath (compared with the mass flow of the thread material) can be so adjusted by flow regulation that almost isothermal drawing takes place.

At the drawing point, the thread tension (Pf) also increases suddenly (Pf3) as the filament must be accelerated to the higher speed and the higher thread speed, after drawing, leads to an even steeper increase in the thread tension ($P_{f4}$), though the fibrils have become thinner after drawing ($F_s$).

The steeper the curves (functions) for the drawing tension $P_s$ and the thread tension $P_f$ intersect each other, the more accurately the drawing point is fixed. There is scarcely any local displacement and the point will not expand to a randomly extended zone. A drawing operation which is controlled in this way leads to high uniformity, high strength and careful thread treatment at optimal temperatures.

The entire process is shown here on a single fibril. However, it is naturally decisive that the 30 to 50 fibrils of a yarn are simultaneously exposed to the same physical conditions as the single fibril mentioned. For this purpose, the drawing bath device must be constructed accordingly.

Figure 2:
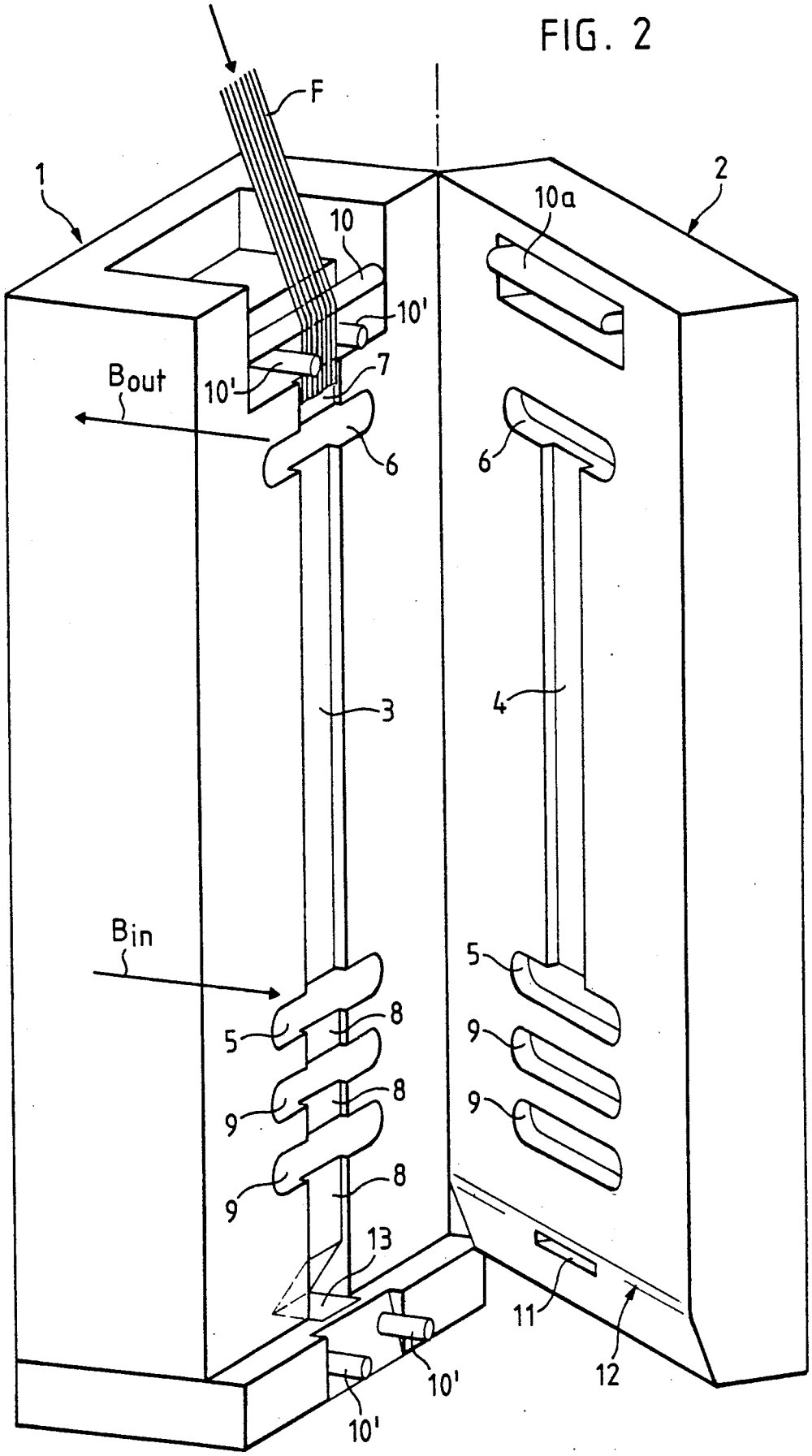

Referring to FIG. 2, the drawing bath device has the following advantages:

I. Physical conditions inside the bath (chamber).

The drawing chamber can be operated with an over pressure, i.e. the air entrained by the fibril can be removed or squeezed out at the chamber inlet. Air attached to the fibril acts as an insulating layer and prevents a precise heat control in the chamber.

The ribbon shaped fibril guidance (i.e. the forced juxtaposed arrangement of the fibrils, preferably in one plane) permits the desired uniform heat treatment and, at the same time, the maximum braking action, as the interaction between the solid and liquid phase is surface-maximum the fibrils are completely surrounded by the liquid.

There are controllable hydrodynamic conditions regarding flow formation and turbulence so that regulation can take place by a forced counterflow of the bath medium and by hydrodynamic baffle plates.

There are advantageous conditions for the temperature control (energy exchange) in the fibrils, namely, the sink to source ratio is ideal because the specific enthalpy of the bath is much higher than that of the fibril. If the fibril is the heat source (in the case of overheating), then the bath is a very large sink for absorbing the energy. If the fibril is the heat sink (on heating), then the bath is a very large source for delivering the necessary energy. Therefore, the energy flow is always high in the correct direction in order to obtain high dynamics in the heat control.

The bath is "enclosed" on both sides and functions in a positionally independent manner. The hydrodynamic action is superimposed on the hydrostatic action.

II. Conditions at the thread inlet and outlet.

The narrow inlet opening and the chamber pressure which counter acts the passage of the thread at the entry into the chamber reduce both introduction of air (with the associated uncontrollable insulating action between fibrils and bath liquid) and friction in the event of contact between the fibrils and the walls at the narrow inlet opening.

There is also good closure of the inlets and outlets through the individual guidance of each fibril. This permits narrow slit-like channel cross-sections which are well closed by the individual juxtaposed fibrils (quasi-closed bath) .

Leakage at the thread outlet is reduced by providing a plurality of small labyrinth-like transverse chambers which act as intermediate chambers and can be equipped with additional means, such as suction means. This also leads to advantages as compared with a hole with a round cross-section at a thread bundle exit. The spray mist forming at the exit point can be sucked off.

There is a further effective removal of bath liquid entrained on the fibril surface by centrifuging and/or blowing away with air. This permits the use of high-viscosity bath media which increases the braking action and thus reduces the overall length.

III. Handling the apparatus (also in running process)

As there is no circumferentially closed ring, there is no need for threading with a thread cutting.

The thread can be inserted rapidly and easily in a junction plane of the block in which the fibril axes pass with the block open.

Insertion can be automated in the case of a running process.

Inspection and, if necessary, cleaning can easily take place with the yarn channel open.

The use of ceramic materials which are difficult to produce can be restricted, the yarn channel can be easily hardened or coated with hard materials, which leads to a longer service life and inspection intervals.

Parts of the yarn channel (cover part) can be easily replaced in order to introduce new functions.

A long list of advantages has been given, so that these points can be borne in mind in the following and the meaning of the individual details will be immediately clear.

Referring to FIG. 2, the device consists substantially of a two-part block with a base 1 and a cover 2. Both these parts can be joined by means of a hinge with the base 1 having all the necessary connections. For closing purposes, the cover 2 is pivoted on the base 1 or is mounted on the base 1 and fastened with a clamp. It should be noted that the active surface which is exposed to the bath pressure should be small compared to the overall block. Thus, the working pressure forcing apart the two parts of the chamber acts on a small surface between the base and the cover. It is also advantageous if the interia of the device offers a resistance to dynamic processes such as through-flow of liquid to build up chamber pressure, thread passage (e.g. of a plurality of threads) and the like. The base 12 has a channel 3 which cooperates with a channel 4 in the cover 2 to form a drawing bath channel.

The drawing bath channel 3,4 has a rectangular slit-like cross section, which is correspondingly formed at the inlet and the outlet. This permits narrow inlet and outlet points and consequently low leakage rates. Particularly, in the case of overpressure in the bath medium. This also makes possible the required individual guidance of the fibrils, arranged here as a ribbon in one plane.

The parallel fibril guidance in a single plane leads to an additional advantage compared with the parallel thread bundles of previously known techniques (no significance is attached to the capillary action of such a thread bundle for fibril wetting). The thermal contact with the bath liquid made possible in this way is excellent and the high uniform liquid friction of all the fibrils at very high thread speeds leads to excellent thread quality. This is all made possible using a small easily portable apparatus which can be positioned at any required point in the spinning process.

At the entrance point to the drawing bath device, the fibrils F are placed over a cylindrical ceramic pin 10 so that the fibrils are arranged in ribbon form. The ceramic pin is advantageously wetted, although the pin is not actually used for the drawing process. Wetting can take place as in a siphon in that the entry slit is dimensioned in such a way that a little bath liquid passing out always adequately wets the ribbon. In a further embodiment, the ceramic pin 10 may be located in the bath directly at the fibril entrance so that the pin is wetted by the flow through the bath and not by the bath liquid which must be discharged for this specific purpose.

Figure 5:
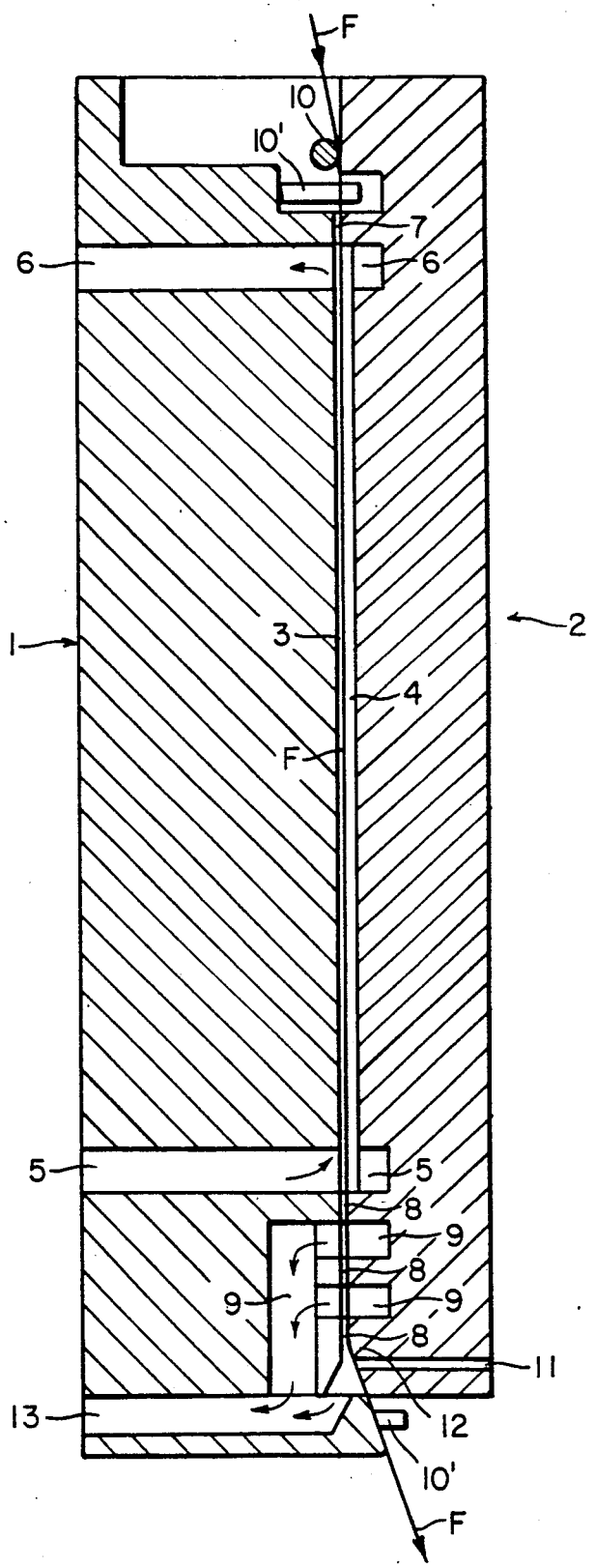
FIG. 5 illustrates a cross sectional view of the drawing bath device of FIG. 2.

As indicated in FIGS. 2 and 5, a thread inlet 7 is provided as a very narrow channel or slit in only the base 1. In addition, a discharge chamber 6 is spaced from the inlet 7 for the discharge of the counter current bath medium while the channels 3, 4 are formed as a continuation of the inlet 7. As indicated, the discharge chamber 6 communicates with each channel 3, 4.

Following a certain length of the channels 3, 4, the base 1 and cover 2 are provided with inflow chambers 5 in order to receive an inflow of the bath medium. As indicated in FIG. 5, the ribbon of fibrils F passes through the drawing bath formed within the channels 3, 4 while being located in the junction plane between the base 1 and cover 2.

Short slit-like channels 8 are provided in the base 1 for the exit of the fibrils F. As indicated, the channels 8 are separated from one another by additional transverse chambers 9 in such a way as to form a type of labyrinth in which entrained chamber liquid can flow out in a pressureless or vacuum-assisted manner (pressure difference being above normal pressure). A draining edge 12 follows this labyrinth with a preferably small deflection radius so that the fibril ribbon F can be deflected and squeezed out.

An air discharge nozzle 11 is also disposed directly below the draining edge 12 to assist in the separation of entrained chamber liquid from the fibrils. A suction opening 13 is also provided opposite the nozzle 11 in order to receive air and any entrained liquid. The suction opening 13 is particularly useful for drawing off liquid spray which may form.

Referring to FIGS. 3*a* and 3*b*, the channel cross section at the inlet and outlet points 7, 8 (FIG. 3*a*) and in the drawing bath 3, 4 (FIG. 3*b*) is of rectangular shape. As indicated above, the channels recessed in the base 1 correspond with those in the cover 2. The chambers 5, 6, 9 are also arranged in the same way. This makes it possible to use various shapes of covers with one base so that the channel characteristics can be varied.

The drawing in process can be performed in a highly automated manner in the device 1, 2.

For example, in order to effect a start-up, the liquid inflow and the blowing air can be interrupted. Thereafter, the cover 2 can be opened relative to the base 1 so that the fibrils F can be laid into the entry and exit points 7, 8 between the guide pins 10'. The fibrils thus lay in a narrow ribbon in one plane. Thereafter, the cover is placed over the base 1 and fixed in place. The bath liquid is then introduced into the channels 3, 4 via the inlet chamber 5 and the blowing or suction air is put into effect. The heat action and braking action begins slowly and in controlled manner.

During laying in of the fibrils, the fibrils extending from the drawing bath outlet are laid by a suction gun on a following thread delivery mechanism such as a roll or winder. If the suction force of the gun is too low to draw through the thread which is exerting resistance due to the excessive braking force of a liquid bath, it may be necessary to place the thread on the following delivery means prior to release of the chamber medium into the device 1, 2. As soon as the thread is sufficiently entrained there, the chamber medium can be released and the process started.

Figure 4:
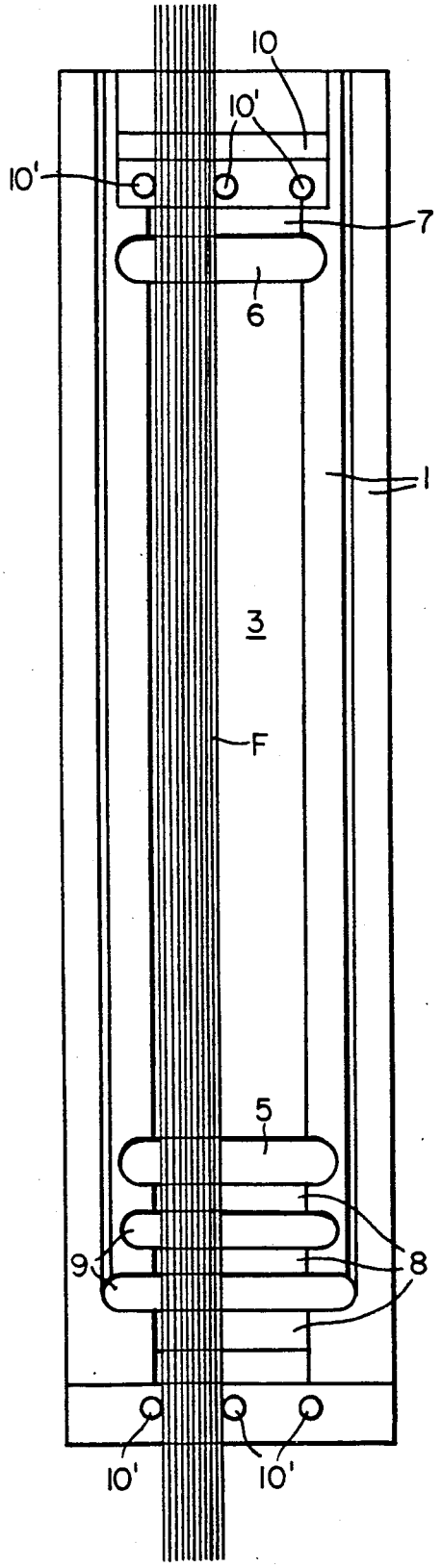
FIG. 4 illustrates a front view of a base of a modified drawing bath device in accordance with the invention.

Referring to FIG. 4, wherein like reference characters indicates like parts as above, the drawing device may be constructed for handling several threads, i.e. groups of fibrils F. In the illustrated case, the device is constructed for handling two threads. To this end, three ceramic pins 10' are disposed at each end of the base 1 in order to provide two thread guides. Of note, only the left-hand thread guide is illustrated with a fibril ribbon for purposes of simplicity.

As indicated, the channel 3 for the drawing chamber is widened along with the respective chambers 5, 6, 9 to accommodate the multiple threads.

Thus, while increasing the number of channels and, therefore, the capacity of the drawing device, there is no corresponding "infrastructure" expenditure, such as, for example, for the pumps for the chamber liquid and the suction air.

Referring to FIG. 5, which also represents a cross sectional view of the device of FIG. 4, the cover 2 for the multiple thread construction is provided with similarly widened channels and chambers as the base 1. Further, in both the base 1 and cover 2, the chamber sections can be given an optimum hydraulic shaping depending upon the chamber medium used; in which case, a different cover 2 can be mounted on the base 1.

Referring to FIG. 2, the drawing device can be provided with a mechanical brake means, for example, in the form of a pin 10*a* which is located in the cover 2. As indicated in FIGS. 6A and 6B, the guide pin 10 and braking pin 10*a* are disposed so as to cause a looping of the fibrils. The looping angle and, therefore, the braking action can be adjusted or chosen by advancing or moving back the pin 10*a*. To this end, the pin 10*a* is mounted so as to be adjustable relative to the pin 10. Thus, the drawing point in the thread movement direction can be displaced from point a (see FIG. 6C) to point a', i.e. towards the thread inlet 7. This leads to the following advantage.

Every so often, it may occur that the drawing bath is to function at a lower speed. The resulting hydrodynamic braking loss is then compensated by the upstream mechanical brake means because the chamber length cannot be increased. However, the braking action of the mechanical brake means must not be so high that the filament drawing to be obtained occurs on the pins. This is because the fibrils have not yet received the ideal drawing temperature roughly corresponding to the chamber temperature while on the upstream pins. Advantageously, the pins 10, 10*a* are positioned in such a way that they are also wetted with the chamber liquid.

If it is preferred to use the mechanical and hydrodynamic braking action together, then a braking pin pair is provided in the drawing bath area. In this case, one pin 10 is located in the base 1 while the other pin 10*a* is located in the cover 2. The ribbon looping angle is automatically formed when mounting the cover 2 onto the base 1. The mechanical braking means is then completely immersed in the chamber liquid and consequently brakes in a moderate manner.

A further modification in the provision of a mechanical braking means can be provided in the base 1 and cover 2 by means of a number of baffle plates (not shown) which force the ribbon out of the junction plane of the base 1 and cover 2 in order to impart a sinuous configuration to the ribbon. In this way, the fibrils may be guided through the flow path in a plane or plane spaced from the mating plane between the base 1 and cover 2. In any event, the hydrodynamic flow behavior of the chamber flow must not be decisively influenced by the sinuous movement of the filament.

The subdivision of the chamber by a junction plane into a base 1 and a cover 2 which is a complementary part only permits variations of the device in a simple manner.

Referring to FIG. 7, wherein like reference characters indicate like parts as above, the drawing device may be constructed so that the channel 3 in the base 1 extend from the inlet 5 to the outlet 6 while the channel 4 in the cover 2 extends from the inlet 5 to a ceramic pin 10 spaced downstream of the outlet 6. In this case, the cover 2 is subdivided into a main cover part containing the channel 4 and a sealing cover part 2' over the remainder of the channel 3. In addition, a thread entrance slit 7, is located between the two cover parts through which the fibril ribbon F passes into the drawing chamber 3, 4 and from there through an outlet slit 8. As indicated, the fibril ribbon F passes over a rounded deflecting edge1 1 of the cover 2 for passage to a removal unit (not shown). As indicated in FIG. 7, the sealing cover part 2' has a corresponding shape 6, in order to supplement the discharge tank 6.

The fibril ribbon F enters the bath at the ceramic pin 10 and is constantly wetted by the bath liquid due to its position close to the bath. Thus, the now shortened drawing bath only extends from the inflow tank 5 to the ceramic pin 10 whereas the total bath length is from the inflow tank 5 to the outflow tank 6. Thus, only part of the total bath length is used for drawing purposes. The base 1 which has remained unchanged permits rapid re-equipping through the mounting of the previous cover 2.

As above, the fibril ribbon F is easily laid in place in the device and is placed over the base 1 in the respective channels 7, 3, 8. Thereafter, the cover 2 is engaged and the ribbon F raised and the sealing cover part fitted. This can obviously take place in some other way.

Of note, the position of the drawing chamber can be chosen at random but is illustrated in a horizontal position for simplicity.

In this embodiment, a more complicated base 1 can be used for several drawing bath lengths. This permits considerable variations between the length, viscosity and other characteristics of the liquid use for the bath. Thus, the parameterization of the drawing process can be extended in the sense of greater flexibility which is generally required in automated processes.

As illustrated in FIG. 7, a means is provided for building up the pressure and controlling the temperature within the bath. Specifically, a pump P is provided for pumping the liquid through the drawing device 1, 2 in a circuit. The reflux or return flow is conducted through a suitable line to a flow regulating means R for controlling the quantity of flow and to deliver the reflux to a thermal device W for heating or cooling the bath liquid.

Referring to FIG. 8, wherein like reference characters indicate like parts as above, the channel 4'of the cover 2 may be provided with an undulating surface in order to influence the flow conditions of the chamber 3, 4,'. The indicated undulating pattern of the channel wall is intended to disturb a laminar flow in such a way that a transverse flow component is formed in order to improve the flow around the fibrils of the ribbon F. In the case of high thread speeds, a "drawing along" of the bath liquid is reduced or prevented and can also be counteracted by a corresponding countercurrent. In the case of a sufficiently high thread tension, the fibrils passing through are only slightly deflected from the junction plane between the base 1 and cover 2.

Referring to FIG. 9, wherein like reference characters indicate like parts as above, the base 1 may also be provided with an undulating surface which defines a wall of the channel 3' for optimization purposes. The waviness and displacement between the depth and height of the undulations is merely intended to indicate how flow-effective disturbance centers or deflections can be incorporated so as to lead to good drawing results and thread qualities at higher speeds, short baths and the like. Numerous variations are possible and through skillful manipulation unexpected effects can be obtained. In this respect, the bath shortening measures can obviously be combined with the disturbance center measures.

Where the drawing device is incorporated as a fixture into an overall plant, a structure as illustrated in FIG. 7 may be preferable. With portable means, reference would be given to a device as shown in FIG. 2.

All the described embodiments can be operated in countercurrent and cocurrent manner as well as in a positionally independent manner and with control chamber pressure.

In particular, the drawing device can be constructed for specific dynamic conditions such as thread speed, viscosity, chamber pressure, temperature, counterflow intensity, specific bath medium and the like. Thus, the complete device can be tailored to a specific drawing function.

While the illustrated embodiments show the fibril ribbon as moving in a flat plane, it is also possible to provide a pin with a slightly curved surface so as to move the fibrils in a path which has a curvilinear cross section. Thus, instead of using a cylindrical pin, a pin with a curved surface can be used.

Various modifications may be made in the chamber liquid, for example, the liquid may be heated so as to function above its blowing point. Further, the mass flow through threading chamber may be such that there is an isothermal temperature control.

What is claimed is:

1. In a process for drawing synthetic filaments, the steps of providing a drawing bath; and guiding a plurality of synthetic filaments in a parallel manner and in a narrow ribbon shaped pattern into the drawing bath and effectively hydrodynamically braking said filaments while simultaneously drawing said filaments.

2. A process as set forth in claim 1 which further comprises the step of causing the drawing bath to move in a parallel flow pattern to the filaments.

3. A process as set forth in claim 2 which further comprises the step of causing a transverse flow of the bath onto the filaments.

4. A process as set forth in claim 1 which further comprises the step of guiding the filaments over a deflecting device to impose a mechanical braking force on the filaments.

5. A process as set forth in claim 4 wherein the deflecting device is a brake pin.

6. A process as set forth in claim 5 which further includes the step of wetting the brake pin with the drawing bath.

7. A device for drawing synthetic filaments comprising a base;

a cover mounted on said base for movement between an open position and a closed position, at least one of said base and said cover has a channel to define a flow path for a drawing bath in said closed position;

means at one end of said flow path for guiding a plurality of synthetic filaments in a parallel manner and in a narrow ribbon shaped pattern into said channel for passage therethrough; and means for passing a bath liquid into said flow path for drawing of the filaments passing therethrough.

8. A device as set forth in claim 7 wherein said means for guiding is a cylindrical pin.

9. A device as set forth in claim 7 wherein said channel is of narrow rectangular shape.

10. A device as set forth in claim 7 which further comprises an inlet in said base for supplying bath liquid to one end of said channel and an outlet in said base for exhausting bath liquid from an opposite end of said channel.

11. A device as set forth in claim 7 which further comprises at least one chamber in communication with a second end of said flow path for removal of liquid from the filaments passing through said second end of said flow path.

12. A device as set forth in claim 11 which further comprises a suction means in communication with said chamber for drawing liquid therefrom.

13. A device as set forth in claim 7 which further comprises an air outlet nozzle at a second end of said flow path for blowing air across the filaments thereat to remove liquid therefrom.

14. A device as set forth in claim 13 which further comprises a suction opening opposite said nozzle to receive air and entrained liquid therein.

15. A device as set forth in claim 7 which further comprises a mechanical brake means in said flow path for the filaments.

16. A device as set forth in claim 15 wherein said brake means includes at least one brake pin disposed across an inlet end of said flow path.

17. A device as set forth in claim 15 wherein said brake means includes a plurality of baffle plates in said flow path for guiding the filaments through said flow path in a plane spaced from a mating plane between said base and said cover.

18. A device as set forth in claim 7 wherein at least one of said base and said cover has an undulating surface defining a wall of said channel.

19. A device for drawing synthetic filaments comprising means defining a flow path for a drawing bath;

means for guiding a plurality of synthetic filaments in a parallel manner and in a narrow ribbon shaped pattern into said flow path; and means for passing a bath liquid into said flow path constituting means for hydrodynamically braking of the filaments and for simultaneously drawing of the filaments passing therethrough.

20. A device as set forth in claim 19 wherein said means defining a flow path includes a base and a cover mounted on said base for movement between a closed position and an open position relative to said base, at least one of said base and said cover having an elongated channel to define said flow path.

21. A device as set forth in claim 20 wherein said cover has an entrance slit for the filaments for entry into an intermediate point of said flow path.

22. A device as set forth in claim 21 wherein said cover has a sealing part to fit over a channel in said base.

23. A device as set forth in claim 22 wherein at least one of said walls has an undulating surface to effect a transverse flow of the bath liquid onto the filaments.

24. A device as set forth in claim 19 which further comprises a closed circuit including a pump for pumping the bath liquid through said flow path at a predetermined pressure, a flow regulating means for controlling the quantity of flow in said flow path and a thermal device for controlling the temperature of the bath liquid in said flow path.

* * * * *

UNITED STATES PATENT AND TRADEMARK OFFICE

CERTIFICATE OF CORRECTION

PATENT NO. : 5,046,225

DATED : September 10, 1991

INVENTOR(S) : FELIX GRAF

It is certified that error appears in the above-identified patent and that said Letters Patent is hereby corrected as shown below:

Column 1, line 19 change "This" to -This opinion is-
Column 4, line 29 change "th" to -the- Column 6, line 30 change "interia" to -inertia-
Column 6, line 33 change "12" to -1-
Column 9, line 4 change "extend" to -extends-
Column 9, line 10 change "7" to -7'-
Column 9, line 14 change "edge 11" to -edge 12-
Column 9, line 16 change "6" to -6'-

Signed and Sealed this

Seventeenth Day of August, 1993

Bruce Lehman

*Attest:*

BRUCE LEHMAN

*Attesting Officer*

*Commissioner of Patents and Trademarks*